United States Patent [19]

Shaw

[11] 4,281,993

[45] Aug. 4, 1981

[54] SEMICONDUCTOR LASER ALIGNMENT DEVICE

[75] Inventor: Bon F. Shaw, Winter Park, Fla.

[73] Assignee: The United States of America as represented by the Secretary of the Navy, Washington, D.C.

[21] Appl. No.: 150,874

[22] Filed: May 19, 1980

[51] Int. Cl.[3] ..... F41F 27/00; F41G 3/26

[52] U.S. Cl. ..... 434/22; 33/241; 42/1 A; 273/310; 362/113

[58] Field of Search ..... 434/21, 22; 33/241, 33/DIG. 21; 42/1 A; 362/110, 111, 112, 113, 114; 273/310

[56] References Cited

U.S. PATENT DOCUMENTS

| | | | |
|---|---|---|---|
| 3,633,285 | 1/1972 | Sensney | 434/22 |
| 3,792,535 | 2/1974 | Marshall et al. | 434/22 |
| 3,867,764 | 2/1975 | Dunmire et al. | 33/DIG. 21 X |
| 3,938,262 | 2/1976 | Dye et al. | 434/21 |
| 4,026,054 | 5/1977 | Snyder | 42/1 A |
| 4,102,059 | 7/1978 | Kimble et al. | 434/22 |
| 4,136,956 | 1/1979 | Eichwaber | 362/111 X |
| 4,161,076 | 7/1979 | Snyder | 362/113 X |
| 4,177,580 | 12/1979 | Marshall et al. | 434/22 |
| 4,195,422 | 4/1980 | Budmiger | 434/22 X |
| 4,212,109 | 7/1980 | Snyder | 33/241 |

*Primary Examiner*—William H. Grieb

*Attorney, Agent, or Firm*—Richard S. Sciascia; Robert W. Adams; David S. Kalmbaugh

[57] ABSTRACT

A semiconductor laser alignment device for aiming a laser light beam, broadcast by a weapon, along an optical light path such that the laser light beam is in alignment with the aiming direction of the weapon at a target which is located a predetermined distance from the weapon. The semiconductor laser alignment device comprises a tubular housing attached to the barrel of the weapon, a laser diode located within the tubular housing for broadcasting the laser light beam, and a projecting lens for collimating the laser light beam broadcast by the laser diode. Zeroing means connected to the laser diode positions the laser diode such that the laser light beam broadcast by the laser diode is in alignment with the line of sight of the weapon.

12 Claims, 5 Drawing Figures

SEMICONDUCTOR LASER ALIGNMENT DEVICE

BACKGROUND OF THE INVENTION

This invention relates generally to an aiming device for attachment to a weapon. In particular, this invention allows for the aiming of a laser light beam, broadcast by the weapon, along an optical light path such that the laser light beam is in alignment with the line of sight of the weapon at a predetermined distance from the weapon.

DESCRIPTION OF THE PRIOR ART

A wide variety of alignment devices are available for aligning a laser light beam broadcast by a weapon with the line of sight of the weapon. These devices, in turn, permit a marksman to aim the weapon at a target, and score a hit thereon whenever the marksman's aim is accurate.

One such aiming device of the prior art comprises a mounting support attached to a weapon, and front and rear mounts connected to the mount support, one of which is vertically extendable and retractable with respect to the mounting support, and the other of which is laterally movable with respect to the mounting support. This aiming device of the prior art allows the aiming direction of a laser light source attached thereto to be adjusted in both the horizontal and vertical directions.

A second such device of the prior art includes a laser aiming light attached by a moulded portion to an aiming light adapter. The aiming light adapter is, in turn, connected to a weapons adapter, which is locked onto a weapon. The aiming light adapter has thereon horizontal and vertical adjusting and locking means for positioning the laser aiming light with respect to the boresight of the weapon.

The aforementioned devices of the prior art, while satisfactory for their intended purpose of aligning a laser light beam broadcast by a weapon with the line of sight of the weapon, ordinarily leave something to be desired, especially from the standpoints of alignment accuracy, design complexity, and cost effectiveness. In particular, with respect to the latter mentioned device of the prior art, the design thereof is very sophisticated and contains a combination of elements that is very different from that of the present invention.

SUMMARY OF THE INVENTION

The subject invention overcomes some of the disadvantages of the prior art, including those mentioned above, in that it comprises a relatively simple laser alignment device which aligns a laser light beam broadcast by a weapon with the line of sight of the weapon at a predetermined distance from the weapon.

Included in the subject invention is a tubular housing having a rear end plate attached to the barrel of the weapon, and a laser diode located within the tubular housing for broadcasting a laser light beam along an optical light path. Zeroing means mounted within the tubular housing, and connected to the laser diode, positions the laser diode such that the laser light beam broadcast by the laser diode is in alignment with the aiming direction of the weapon. A projecting lens, mounted within a lens retainer cap assembly which is threadably connected to the tubular housing, collimates the laser light beam broadcast by the laser diode.

DESCRIPTION OF THE PREFERRED EMBODIMENT

Figure 1:
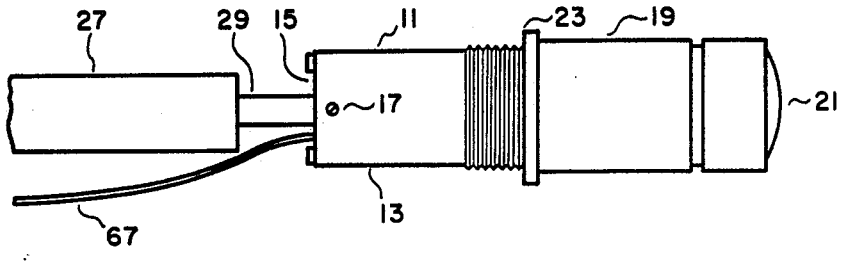
FIG. 1 is a schematic side view of a laser alignment device constituting the subject invention.

The preferred embodiment of the subject invention will now be discussed in some detail in conjunction with all of the figures of the drawings, wherein like parts are designated by like reference numerals, insofar as it is possible to do so.

Referring now to FIG. 1, there is shown a laser alignment device 11 comprising a tubular housing 13 with a rear end plate 15 mounted on the back end thereof by suitable means, such as a plurality of screws 17. Threadably connected to the front end of tubular housing 13 is a lens retainer cap assembly 19 which has mounted therein a projecting lens 21. A locking nut 23 which is screw threaded onto tubular housing 13 locks lens retainer cap assembly 19 in a fixed position relative to tubular housing 13.

Figure 5:
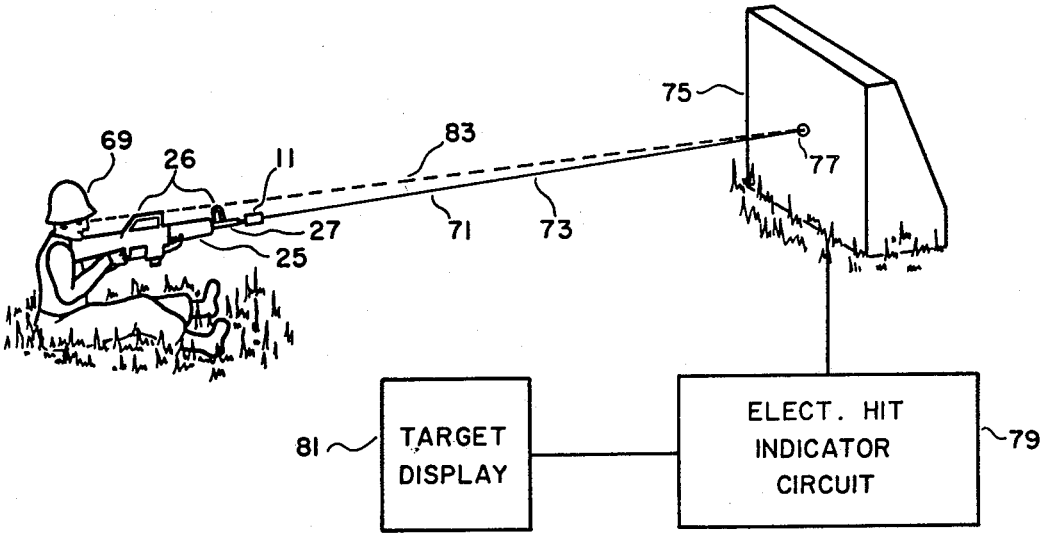
FIG. 5 is a pictorial representation of the procedure utilized to align the laser diode of the laser alignment device of FIG. 1.
Figure 2:
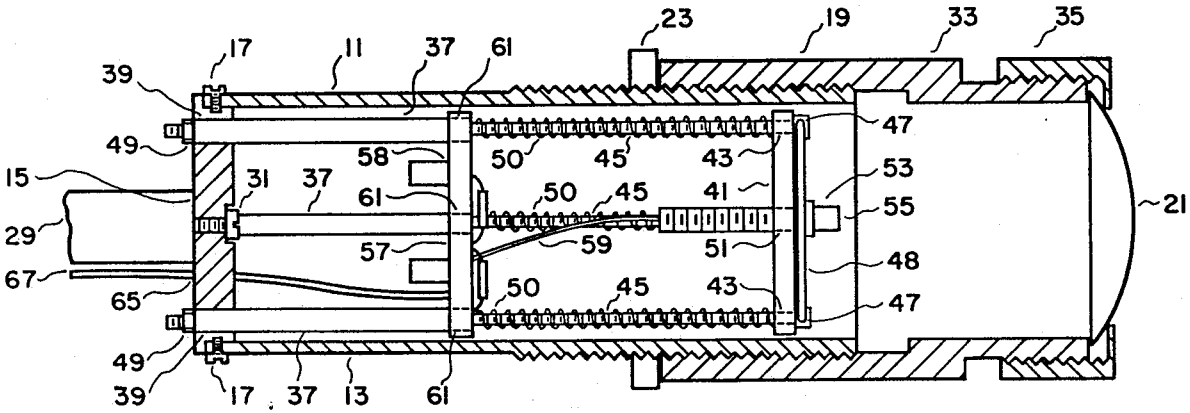
FIG. 2 is a cross-sectional view of the laser alignment device of FIG. 1.

Referring now to FIGS. 1, 2, and 5, there is shown a weapon 25 having a target sighting apparatus 26 which includes front and rear sights, not shown, and a barrel 27. Fixedly connected to barrel 27 of weapon 25, as by conventional means such as a weld, is a rod 29. Connected to rod 29 by means of a screw 31 is a rear end plate 15 of tubular housing 13.

Referring now to FIG. 2, there is shown lens retainer cap assembly 19 which, as mentioned above, is threadably connected to tubular housing 13. Lens retainer cap assembly 19 includes a lens retainer casing 33 and a lens cap 35 which is screw mounted to lens retainer casing 33. Mounted within lens retainer cap assembly 19 and secured thereto by lens cap 35, is projecting lens 21.

Figure 3:
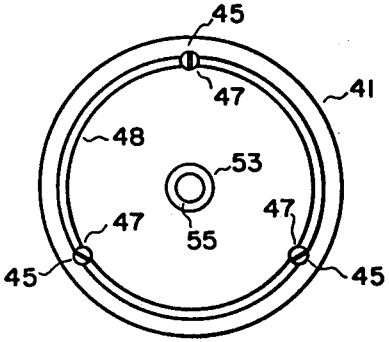
FIG. 3 is a top view of the diode retainer plate of the laser alignment device of FIG. 1.

Referring now to FIGS. 2 and 3, there is shown a trio of tubular shaped support members 37, each of which is mounted within one of a trio of apertures 39 located near the periphery of rear end plate 15.

Positioned near the front end of tubular housing 13 is a diode retainer plate 41 which has located near the periphery thereof a trio of apertures 43, each of which is in alignment with one of the trio of tubular shaped support members 37.

Passing through each of the trio of apertures 43 of diode retainer plate 41 and the tubular shaped support member 37 in alignment therewith is an adjustment screw 45. Passing through an aperture 47 located in the head of each adjustment screw 45 is a locking ring 48, which functions as a restrainer so as to prevent the rotational movement of each adjustment screw 45 whenever the aiming direction of diode retainer plate 41 is adjusted, as will be discussed more fully below.

Figure 4:
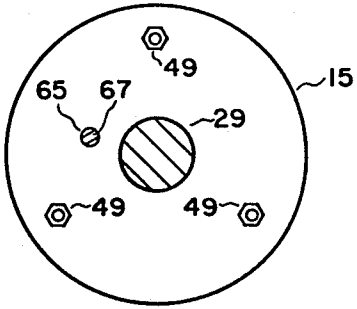
FIG. 4 is a top view of the rear end plate of the laser alignment device of FIG. 1.

Referring now to FIGS. 2, 3, and 4, there is shown a trio of adjustment nuts 49, each of which is threadably connected to one of the aforementioned adjustment screws 45. Located on the periphery of each adjustment screw 45 is a compression spring 50 which functions as a retainer so as to maintain the position of diode retainer plate 41 relative to any adjustment of the aforementioned adjustment screws.

Screw mounted into an aperture 51 located in the center of diode retainer plate 41 is a laser diode casing 53 having a laser diode 55 therein.

Positioned within tubular housing 13 is a circuit board 57 which has mounted thereon the electronic components of a laser pulser circuit 58, the output of which is connected to the input of laser diode 55 by a wire 59. Located near the periphery of circuit board 57 are a trio of apertures 61, each of which is secured to one of the trio of tubular shaped support members 37 by conventional means such as a press fit.

At this time it may be noteworthy to mention that for a complete description of the electronic components utilized in laser pulser circuit 58 and the interconnections therebetween, reference is made to U.S. Pat. No. 3,792,535 entitled Laser Rifle Simulator System, by Albert H. Marshall and George A. Siragusa.

Passing through an aperture 65 located within rear end plate 15 is a wire 67 which connects the trigger mechanism of weapon 25 to the input of laser pulser circuit 58.

Referring now to FIG. 5, there is shown a marksman 69 schematically depicted as holding weapon 25. Weapon 25, in response to the pulling of the trigger mechanism thereof by marksman 69, broadcasts along an optical light path 71 a laser light beam 73. Spatially disposed downstream at a predetermined distance from marksman 69 is a target 75 which has located in the center thereof a laser diode light sensor 77 adapted for receiving laser light beam 73. The output of laser diode light sensor 77 is, in turn, connected to an electronics hit indicator circuit 79 with the output thereof connected to a target display 81.

For a description of laser diode light sensor 77, electronics hit indicator 79 and the interconnections therebetween, reference is hereby made to U.S. Pat. No. 4,177,580 entitled Laser Marksmanship Target, issued to Albert H. Marshall and George A. Siragusa.

At this time it would perhaps be noteworthy to mention that all of the elements and components which comprise the subject invention are well known, conventional, and commercially available.

The operation of the subject invention will now be discussed in conjunction with all of the figures of the drawing.

Referring first to FIG. 5, there is shown marksman 69 sitting on the ground and shooting weapon 25 at target 75 which is located at a predetermined distance from marksman 69. Weapon 25, which marksman 69 is firing in this particular instance, is a laser rifle which shoots laser light beam 73 toward laser diode light sensor 77 of target 75 every time marksman 69 activates the trigger mechanism of weapon 25.

Whenever marksman 69 hits laser diode sensor 77 with laser light beam 73, electronics hit indicator circuit 79 will supply to target display 81 a hit indicator signal to be displayed thereby. This, in turn, indicates to marksman 69 that laser light beam 73 broadcast by laser diode 55, FIG. 2, is in alignment with the target sighting apparatus 26 of weapon 25.

At this time it may be noteworthy to mention that a dashed line 83 will be utilized to depict the line of sight of marksman 69 through target sighting apparatus 26 to target 75. Thus, to properly align laser light beam 73 with the line of sight of marksman 69, laser diode 55 must be orientated such that optical light path 71 is in alignment with dashed line 83 at laser diode light sensor 77 of target 75. Otherwise, a shooting error would occur since laser alignment device 11 which has laser diode 55 therein is mounted underneath the line of sight of marksman 69.

Referring now to FIGS. 2 and 5, laser light beam 73 is collimated by turning lens retainer cap assembly 19 so as to adjust the aforementioned lens retainer cap assembly such that laser diode 55 is located at the focal point of projecting lens 21. Locking nut 23, as mentioned above, locks lens retainer cap assembly 19 in a fixed position relative to tubular housing 13, assuring that whenever marksman 69 fires weapon 25 the laser light beam broadcast thereby is collimated.

Weapon 25 is then boresighted by turning the appropriate adjustment nuts 49 so as to adjust the angular position of diode retainer plate 41 with respect to a vertical axis, not shown, such that laser light beam 73 broadcast by laser diode 55 is in alignment with dashed line 83 at laser diode light sensor 77 of target 75. Conventional means, such as a socket wrench, not shown, or a wrench, not shown, may be utilized to turn adjustment nuts 49.

As mentioned above, locking ring 48 functions as a restrainer so as to prevent the rotational movement of each adjustment screw 45 whenever the aiming direction of diode retainer plate 41, and thus laser diode 55, is adjusted.

At this time it may be noteworthy to mention that the elements of the subject invention utilized to align laser light beam 73 with the line of sight of weapon 25 are located within laser alignment device 11, with the exception of adjustment nuts 49. This, in turn, allows for the utilization of the subject invention in a combat training session without the misalignment of laser diode 55, and thus the misalignment of laser light beam 73 with the line of sight of weapon 25 due to the possible bumping of the subject invention during the training session.

From the foregoing, it may readily be seen that the subject invention comprises a new, unique, and exceedingly useful laser alignment device which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A semiconductor laser alignment device comprising in combination:

a tubular housing having at the back end thereof a rear end plate, said rear end plate having a trio of apertures located near the periphery thereof;

a weapon having a barrel, the barrel of said weapon being fixedly attached to the rear end plate of said tubular housing;

light source means located within said tubular housing adapted for broadcasting a laser light beam along an optical light path;

means threadably connected to the front end of said tubular housing adapted for collimating the laser light beam broadcast by said light source means; and zeroing means mounted within said tubular housing and having said light source means connected thereto for positioning said light source means such that the laser light beam broadcast by said light source means is in alignment with the aiming direction of said weapon.

2. The semiconductor laser alignment device according to claim 1, wherein said weapon comprises a rifle.

3. The semiconductor laser alignment device according to claim 1, wherein said light source means comprises a laser diode.

4. The semiconductor laser alignment device according to claim 1, wherein said means for collimating the laser light beam broadcast along said optical light path comprises:

a lens retainer cap assembly threadably connected to the front end of said tubular housing; and a projecting lens mounted within said lens retainer cap assembly.

5. The semiconductor laser alignment device according to claim 1, wherein said zeroing means comprises:

a diode retainer plate positioned within said tubular housing near the front end thereof, said diode retainer plate having said light source means screw mounted to the center thereof;

a trio of apertures located near the periphery of said diode retainer plate and passing therethrough, each aperture of which is in alignment with one of the trio of apertures of said rear end plate;

a trio of tubular shaped support members, each tubular shaped support member of which is mounted within one of the trio of apertures of said rear end plate;

a trio of adjustment screws, each adjustment screw of which passes through one of the trio of apertures of said diode retainer plate and through one of said trio of tubular shaped support members, and each adjustment screw of which has an aperture passing through the head thereof;

a trio of adjustment nuts, each adjustment nut of which is threadably connected to one of said trio of adjustment screws;

a trio of compression springs, each compression spring of which is mounted around the periphery of one of said trio of adjustment screws; and a locking ring passing through the aperture of the head of each of said trio of adjustment screws.

6. The semiconductor laser alignment device according to claim 1, further characterized by a circuit board mounted within said tubular housing, said circuit board having mounted thereon a laser pulser circuit, the output of which is connected to the input of said light source means.

7. The semiconductor laser alignment device of claim 1, further characterized by:

a target spatially disposed downstream a predetermined distance from said weapon;

a laser diode light sensor located in the center of said target;

an electronics hit indicator circuit having an input connected to the output of said laser diode light sensor, and an output; and a target display having an input connected to the output of said electronics hit indicator circuit.

8. A laser light aiming device comprising, in combination:

a tubular housing having at the back end thereof a rear end plate, said rear end plate having a trio of apertures located near the periphery thereof;

a lens retainer cap assembly threadably connected to the front end of said tubular housing;

a projecting lens mounted within said lens retainer cap assembly;

a diode retainer plate positioned within said tubular housing near the front end thereof, said diode retainer plate having a quartet of apertures, one of which is located at the center of said diode retainer plate, and the remainder of which are located near the periphery of said diode retainer plate;

a laser diode screw mounted within the aperture located at the center of said diode retainer plate;

a trio of tubular shaped support members, each tubular support member of which is mounted within one of the trio of apertures of said rear end plate;

a trio of adjustment screws, each adjustment screw of which passes through one of the apertures located near the periphery of said diode retainer plate, and through one of said trio of tubular shaped support members, and each adjustment screw of which has an aperture passing through the head thereof;

a trio of adjustment nuts, each adjustment nut of which is threadably connected to one of said trio of adjustment screws;

a trio of compression springs, each compression spring of which is mounted around the periphery of one of said trio of adjustment screws; and a locking ring passing through the aperture of the head of each of said trio of adjustment screws.

9. The laser light aiming device according to claim 8, further characterized by a weapon having a barrel, the barrel of said weapon having attached to the end thereof the rear end plate of said tubular housing.

10. The laser light aiming device according to claim 9, wherein said weapon comprises a rifle.

11. The laser light aiming device according to claim 8, further characterized by a circuit board mounted within said tubular housing, said circuit board having mounted thereon a laser pulser circuit, the output of which is connected to the input of said laser diode.

12. The laser light aiming device according to claim 8, further charcterized by:

a target spatially disposed downstream a predetermined distance from said laser alignment device;

a laser diode light sensor located in the center of said target;

an electronics hit indicator circuit having an input connected to the output of said laser diode light sensor, and an output; and a target display having an input connected to the output of said electronics hit indicator circuit.

* * * * *